United States Patent [19]

Lombana

[11] 4,215,637

[45] Aug. 5, 1980

[54] SYSTEM FOR COMBUSTION OF WET WASTE MATERIALS

[75] Inventor: Luis A. Lombana, Belmont, Calif.

[73] Assignee: Envirotech Corporation, Menlo Park, Calif.

[21] Appl. No.: 25,805

[22] Filed: Apr. 2, 1979

[51] Int. Cl.[3] ..... F23G 5/04; F27B 9/22

[52] U.S. Cl. ..... 110/225; 110/346; 432/48

[58] Field of Search ..... 110/221, 224–228, 110/247, 346; 432/18, 23, 48, 133, 139, 144

[56] References Cited

U.S. PATENT DOCUMENTS

| | | | |
|---|---|---|---|
| 1,840,723 | 1/1932 | King | 432/48 X |
| 2,181,190 | 11/1939 | Lewers | 110/225 |
| 3,954,069 | 5/1976 | Loken | 110/221 |
| 3,958,920 | 5/1976 | Anderson | 110/225 X |
| 4,050,389 | 9/1977 | von Dreusche, Jr. | 432/139 X |

*Primary Examiner*—John Petrakes

*Attorney, Agent, or Firm*—Hal J. Bohner; Robert E. Krebs

[57] ABSTRACT

A system for drying and burning wet waste materials includes a multiple hearth furnace having an upper, drying zone and a lower, burning zone. Wet waste material is introduced into the upper, drying zone and dried with a stream of hot air, and the stream of air is then conveyed to a condenser to remove water. The stream of air from the condenser is then conveyed to the center column of the furnace wherein it is heated, and the hot air is then introduced into the lower, burning zone of the furnace to aid combustion. Hot gaseous products of combustion are conveyed from the burning zone to an afterburner, and the gases leaving the afterburner are transferred to a heat exchanger and then discharged. In the heat exchanger a stream of ambient air is heated, and the heated air is then conveyed to the upper, drying zone.

11 Claims, 1 Drawing Figure

SYSTEM FOR COMBUSTION OF WET WASTE MATERIALS

BACKGROUND OF THE INVENTION

1. Field of the Invention

This invention relates to the drying and burning of wet waste materials such as sewage sludge.

2. State Of The Art

Conventional wastewater treatment processes remove pollutants from the wastewater and generate slurries of the removed pollutants. These slurries are generally known as sludge, which contains organic and inorganic solids suspended in a high percentage of water. Disposal of the sludge is accomplished by known methods, and one such method includes dewatering the sludge by filtration or centrifugation and incineration of the dewatered sludge. It is generally recognized that filtration of sludge removes only a fraction of the water, and substantial quantities of water remain with the sludge even after filtration. Therefore, it is desirable to remove additional water from the sludge prior to incineration so that it is not necessary to heat substantial quantities of water in the incineration step. Other materials such as municipal refuse having a substantial percentage of organic materials, can also be dried and incinerated in combination with sludge.

One conventional system for drying and incinerating wet sewage sludge is a multiple hearth furnace. A conventional multiple hearth furnace includes a substantially vertically disposed cylindrical vessel having an inlet at its upper end and an outlet at its lower end. A plurality of hearths are located within the vessel perpendicular to its axis, and spaced apart from one another. A center column is disposed to rotate in the center of the furnace parallel to the axis of the furnace, and a plurality of rabble arms are afixed to the center column parallel to the hearths. When the center column rotates the rabble arms urge material to travel across the hearths, and the hearths are constructed so that material introduced at the upper end of the furnace travels from hearth to hearth downwardly through the furnace in a serpentine path.

In operation of a conventional multiple hearth furnace, wet sludge is introduced into the upper part of the furnace and moved downwardly. Burners affixed to the furnace burn fuel such as natural gas to heat the sludge to dry it. In the lower part of the furnace fuel is burned to burn the sludge thereby forming hot gases which rise to aid in drying the sludge in the upper hearth spaces. It should be understood that the center column and the rabble arms are hollow so that ambient air introduced into the lower end of the center column flows upwardly therethrough and acquires heat from the furnace. The heated air leaves the upper part of the center column and is conveyed therefrom back into the furnace to provide combustion air.

OBJECTS OF THE INVENTION

An object of the present invention is to provide a multiple hearth furnace system for drying and incinerating sewage sludge or other wet waste materials wherein the quantity of fuel to burn and dry the sludge is minimized.

Another object is to provide a system wherein a stream of hot air is used to dry the wet sludge, water vapor is condensed from the stream of air after drying, and the air is forced through the center column to acquire heat. Thereafter, the air is used for combustion in the furnace and the afterburner.

Still another object is to provide a system wherein sludge having certain characteristics can be dried and burned autogenously.

Further objects and advantages of the present invention can be readily ascertained by reference to the following description and drawings, which are offered by way of example only and not in limitation of the invention, the scope of which is defined by the appended claims and by equivalents to the structure, materials and acts set forth hereinafter.

DETAILED DESCRIPTION OF THE PREFERRED EMBODIMENT

Figure 1:
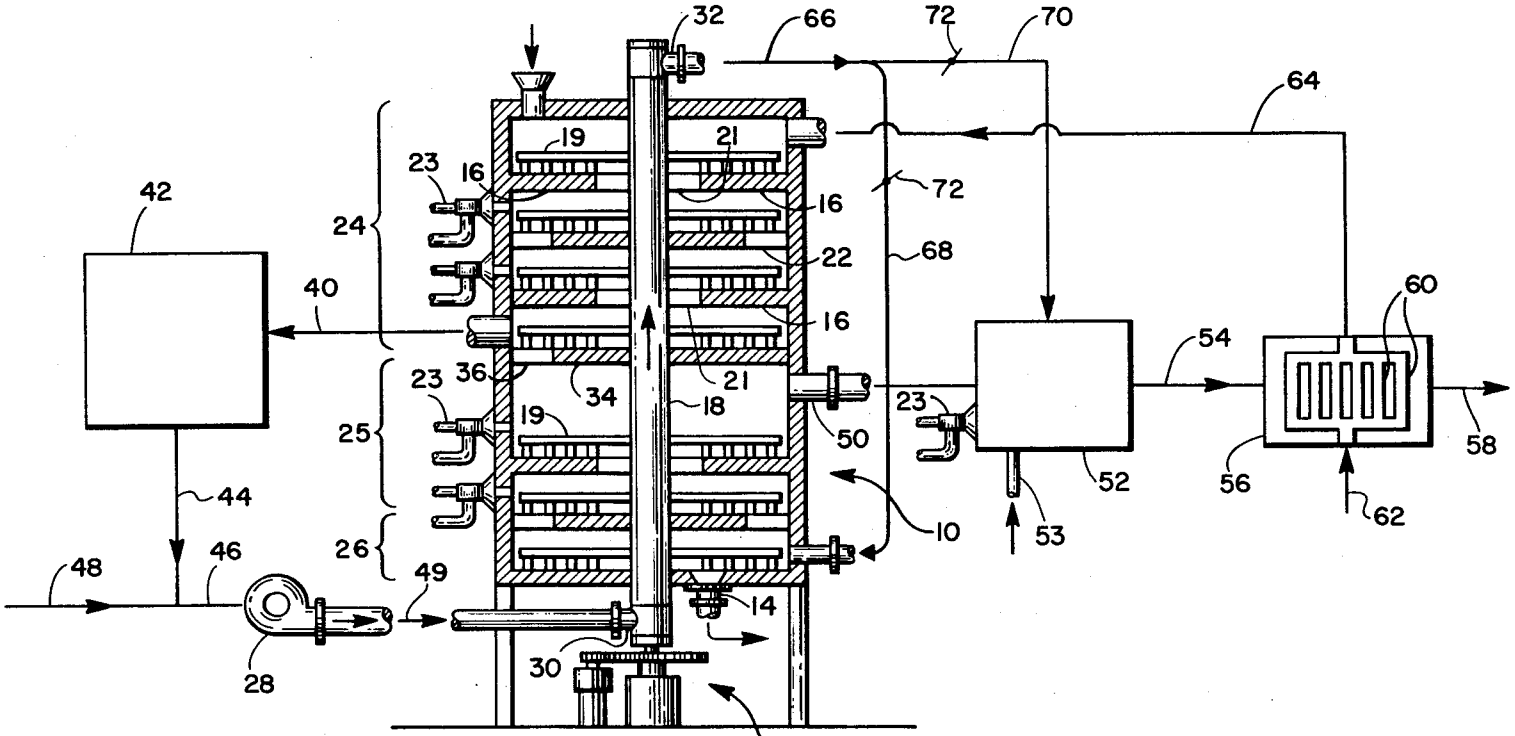
FIG. 1 is a schematic representation of one embodiment of the present system.

The presently preferred embodiment shown in FIG. 1 includes a multiple hearth furnace 10. This multiple hearth furnace includes a substantially vertically disposed, refractory lined cylindrical vessel having an inlet 12 at its upper end and an outlet 14 at its lower end. A plurality of hearths 16 are located within the vessel perpendicular to its axis, and spaced apart from one another. A center column 18 is rotatably disposed in the center of the furnace 10 parallel to the axis of the furnace, and a plurality of rabble arms 19 are affixed to the center column parallel to the hearths 16. Drive means 20 is coupled to the lower end of the center column 18 to cause the center column to rotate so that the rabble arms 19 urge material to travel across the hearths 16. The hearths 16 are constructed so that material flows downward through the furnace in a generally serpentine path. In particular, the uppermost hearth is affixed to the inside of the furnace 10 and spaced apart for the center column 18 a substantial distance to form a port 21, while the next lower hearth is spaced apart from the center column only a short distance and has a plurality of ports 22 formed around its periphery. Successively alternating lower hearths are the same construction as the first two hearths.

A plurality of burners 23 are connected through the side of the furnace 10 in selected hearth spaces. The burners 23 are coupled to sources of pressurized air and fuel, not shown, to provide heat to the furnace.

For the purpose of this description the furnace 10 should be understood to include an upper zone 24 wherein sludge is dried, and a middle zone 25 wherein the dry sludge is charred and volatiles are burned. A lower zone 26 is optionally disposed below the middle zone 25 for burning fixed carbon. Each of these zones comprises one or more hearth spaces. Although each of the zones is illustrated to encompass a particular number of hearth spaces, various operating conditions can dictate the use of different numbers of hearth spaces for a particular zone.

It should be understood that the center column 18 and the rabble arms 19 are hollow and can conduct air. A blower 28 is coupled in gas flow communication with an air housing 30 connected to the lower end of the center column 18. Thereby air can be blown into the lower end of the center column 18 while it rotates. The air travels upwardly through the center column and the rabble arms to exit from a second air housing 32 at the upper end of the center column.

It should be appreciated that the lowermost hearth 34 of the upper zone 24 is unlike the other hearths 16. That is, the hearth 34 has ports 36 located only on its leftmost side. This construction of hearth 34 insures that the ports 36 are substantially blocked by sludge so that no substantial quantity of gas rising in the furnace flows from the middle zone 25 to the upper zone 24; however, sludge moving downwardly through the furnace can pass through port 36 and fall to the middle zone 25.

A conduit 40 is coupled to the lower end of the upper zone 24 to convey gases from the drying sludge to a condenser 42. The condenser 42 is a conventional means to receive hot, wet gases and to cool the gases thereby to condense water from them. A conduit 44 is coupled to the condenser 42 to receive the gases therefrom, and the conduit 44 is coupled to the inlet line 46 of the blower 28. A second conduit 48 is also coupled to the inlet line 46 for permitting the introduction of ambient air into the blower 28. The outlet of the blower 28 is coupled in flow communication with the housing 30 via line 49.

A conduit 50 is coupled to the furnace 10 at the upper end of the middle zone 25 to receive hot gases from the burning sludge, and to convey them to afterburner 52. The afterburner 52 is a conventional device to heat gases which contain odorous compounds and to burn the gases to insure that no odors leave the afterburner. An air inlet 53 is coupled to the afterburner 52 to introduce air thereinto, and a burner 23 is also coupled to the afterburner 52. The afterburner 52 is coupled by conduit 54 to a heat exchanger 56. The illustrated heat exchanger 56 includes a first pass surrounding a plurality of tubes 60 and a second pass within the tubes so that gases in the first and second passes are in heat-exchange relationship. A conduit 58 is coupled to the first pass for exhausting the gases which enter the heat exchanger 56 via line 54. The second pass of the heat exchanger, formed by tubes 60, is coupled to receive ambient air via line 62. The heated ambient air is conducted from the tubes 60 via line 64 to return it to the multiple hearth furnace at the upper end of the upper zone 24.

Coupled to the housing 32 at the upper end of the center column 18 is conduit 66 which is in turn coupled to conduits 68 and 70 via dampers 72. By adjustment of the dampers 72 a controllable quantity of the gas from the line 66 can be directed through line 68 into one or more of the hearth spaces forming the middle zone 25 and the lower zone 26 and into the afterburner 52 via line 70.

In operation of the multiple hearth furnace system described above, wet sludge either alone or mixed with other wet waste materials is fed through the inlet port 12 to fall onto the upper hearth 16. The center column 18 and rabble arms 19 rotate to urge the sludge to move downwardly through the upper zone 24. Fuel is burned in the burners 23 thereby heating the sludge to dry it.

Ambient air is introduced via line 62 to be heated in the heat exchanger 56 to about 1200°–1250° F. The heated air is conveyed by conduit 64 into the upper zone 24 to flow downwardly therethrough with the sludge. This hot air heats the sludge thereby driving off moisture which is carried from the furnace via line 40 to condenser 42. During passage through the upper zone 24 the hot air cools to about 300°–400° F. In the condenser 42 water is removed from the wet gas, and the gas is returned to the lower end of the center column 18 at a temperature of about 80° F. and saturated with water vapor. In practice it is necessary, at certain times, to add additional quantities of air via line 48 to mix with the dry gas in line 44. This mixture of ambient air and saturated gas flows upwardly through the center column 18 and rabble arms 19 to acquire heat. It should be appreciated that the water vapor in the gas has a higher heat capacity than dry air and therefore the saturated gas is capable of absorbing more heat from the center column than would dry air. The heated gas flows from the center column 18 via line 66 to the afterburner 52 or through line 68 to the middle zone 25 and lower zone 26 of the furnace.

Sludge containing less than about 65% water flows downwardly from the upper zone 24 via ports 36 into the middle zone 25 to be burned with inadequate oxygen for complete combustion. This is, the sludge is charred and volatile chemicals are driven therefrom. This process, sometimes called pyrolysis, is discussed in U.S. Pat. No. 4,013,023. After charring in the middle zone 25 the charred sludge then flows downward wherein the fixed carbon remaining therein is burned.

Heated air introduced via line 68 flows upwardly through the lower zone 26 and middle zone 25 to provide combustion air to burn the fixed carbon in the lower zone 26 and partially burn the sludge in the middle zone 25. The burners 23 burn fuel as necessary to provide any needed heat to enchance the charring of the sludge. The gaseous products of combustion and unburned volatiles are exhausted from the furnace via conduit 50 and flow therefrom to afterburner 52. In the afterburner the gases are burned at about 1400° F. to insure complete combustion of any odorous materials. If the temperature begins to rise above an acceptable level, air can be added via line 53 to quench the combustion of the gases. The afterburned gas is passed to the heat exchanger wherein the hot gas heats the ambient air introduced via line 62. After heating the ambient air, the gases are exhausted via line 58 and thereafter transferred to conventional means such as a scrubber or a baghouse, not shown, for further treatment to remove particulate material before discharge to the atmosphere.

I have determined that the present system and process can advantageously dry and burn sludge with a minimum of fuel, and in fact many sludges can be burned autogenously, that is, without fuel after initiation of the process. For example, sludge comprising about 20% or more solids, wherein about 70% or more of the solids are combustible, and the heating value of the combustibles is about 10,000 British Termal Units per pound, can be burned autogenously in the present system.

For operation of the present system in an autogenous condition according to my example, the process is initiated by burning fuel in burners 23 to dry and burn the sludge. However, after the process has stabilized, and the sludge falling from zone 24 to zone 25 is greater than about 35% solids while the temperature is about 1200° F. to 1500° F. in the middle zone 25, the supply of fuel to the burners in zones 24 and 25 is shut off, and the process is thermally self-sustaining.

I claim

1. A system for drying and burning wet waste materials in a furnace having a hollow shaft rotatably mounted in its center, comprising:

a. a drying zone formed in the furnace to receive the wet waste materials;

b. means to introduce a stream of hot air into said drying zone to heat the wet waste materials and carry water vapor therefrom;

c. a burning zone formed in the furnace to receive dried sludge from the drying zone and to burn the dry sludge;

d. condenser means coupled in gas flow communication with said drying zone to receive hot, wet gases from said drying zone and to cool and condense water from the gases;

e. blower means coupled in flow communication with said condenser means to receive the cooled gases from said condenser means and to blow the cooled gases through the hollow shaft to cool the shaft and heat the gases;

f. conduit means coupled in flow communication with the shaft to receive heated gases blown through the shaft and to convey the heated gases into said burning zone for burning therein; and g. an afterburner coupled in flow communication with said burning zone to receive hot gases from said burning zone and to raise the temperature of the hot gases.

2. The system of claim 1 further including second conduit means coupled in flow communication with the shaft to receive heated gases blown through the shaft and to convey the heated gases to said afterburner for burning in said afterburner.

3. The system of claim 1 further including:

a. heat exchange means having a first and a second pass in heat flow communication with one another, said first pass coupled in gas flow communication with said afterburner to receive hot gases from said afterburner;

b. means coupled to introduce air into said second pass of said heat exchange means for heating by the hot gases in said first pass; and c. third conduit means coupled to receive the heated air from said second pass and convey the heated air to said drying zone of the furnace.

4. A system for drying and burning wet waste materials comprising:

a. multiple hearth furnace means having an upper zone for drying the wet waste materials, a lower zone for burning the dried waste materials and a hollow, rotatable shaft;

b. hearth means mounted in said furnace between said upper and lower zones to permit waste materials to fall between the two zones while preventing substantial quantities of gas from rising between the two zones;

c. condenser means coupled in flow communication with the upper zone of said furnace to receive hot, wet gases from the upper zone and to cool and condense water from the gases;

d. blower means coupled in flow communication with said condenser means to receive the cooled gases from said condenser means and to blow the cooled gases through said hollow, rotatable shaft;

e. air introduction means coupled to the upper zone of said furnace to introduce heated air into said zone so that the air flows through the zone to heat the wet waste material and carry water vapor to said condenser means; and f. afterburner means coupled to receive hot gases from the lower zone and to raise the temperature of the hot gases.

5. A system according to claim 4 wherein said furnace has a third zone disposed to receive material from said lower zone and to burn the material.

6. A process for drying and burning wet waste material, comprising the steps of:

a. introducing the wet waste material into a drying zone of a furnace having a center shaft, and heating the material therein to drive water from the material b. conveying a stream of hot gases containing water from the furnace to a condenser for removing water from the hot gases by cooling the hot gases;

c. transferring the dried waste material into a burning zone of the furnace and burning the material therein;

d. conveying the cooled gases from the condenser to the center shaft of the furnace and forcing the cool gases through the shaft to cool the shaft and heat the gases;

e. removing the heated gases from the shaft and transferring at least part of the gases to the burning zone of the furnace to provide air for combustion; and f. removing hot gases from the burning zone and conveying the hot gases to an afterburner for burning therein.

7. The process of claim 6 further including the steps of:

a. transferring the burned gases from the afterburner to heat exchange means to heat a stream of ambient air therein; and b. transferring the heated ambient air to the drying zone to dry the material therein.

8. The process of claim 7 wherein the wet waste material contains about 20% or more solids; about 70% or more of the solids are combustible; and the heating value of the combustible materials is greater than about 10,000 BTU per pound.

9. The process of claim 8 wherein fuel is initially burned in the furnace, and thereafter the supply of fuel burned in the burning and drying zones is stopped so that the process operates autogenously.

10. The process of claim 9 wherein fuel is initially burned until the temperature is about 1200°–1500° F. in the burning zone, and the sludge falling from the drying zone to the middle zone is greater than about 35% solids, and thereafter the supply of fuel is stopped.

11. The process of claim 6 further including the step of transferring part of the heated gases from the shaft to the afterburner for burning therein.

* * * * *